US006195974B1

(12) United States Patent
Greis et al.

(10) Patent No.: US 6,195,974 B1
(45) **Date of Patent: *Mar. 6, 2001**

(54) PROCESS AND DEVICE FOR THE AUTOMATIC INTRODUCTION OF A FIBER SLIVER

(75) Inventors: Dietmar Greis, Ingolstadt; Robert Tuschl, Erlangen, both of (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/442,610

(22) Filed: Nov. 18, 1999

Related U.S. Application Data

(62) Division of application No. 08/164,389, filed on Dec. 9, 1993, now Pat. No. 5,996,182.

(30) Foreign Application Priority Data

Dec. 23, 1992 (DE) ..... 42 43 661
Jun. 26, 1993 (DE) ..... 43 21 367

(51) Int. Cl.[7] ..... D01H 13/02
(52) U.S. Cl. ..... 57/90; 57/279; 19/157
(58) Field of Search ..... 19/25, 157, 159 A, 19/159 R; 57/90, 263, 261, 279, 264, 280, 281

(56) References Cited

U.S. PATENT DOCUMENTS

| | | | | |
|---|---|---|---|---|
| 4,875,256 | | 10/1989 | Gunleinger . | |
| 4,932,201 | | 6/1990 | Meroni et al. . | |
| 4,939,895 | | 7/1990 | Raasch et al. . | |
| 4,969,323 | | 11/1990 | Stahlecker . | |
| 4,977,738 | * | 12/1990 | Stahlecker | 57/281 |
| 4,982,563 | | 1/1991 | Stahlecker . | |
| 5,276,947 | | 1/1994 | Fritschi et al. . | |
| 5,394,683 | | 3/1995 | Krejcik . | |
| 5,636,411 | * | 6/1997 | Greis et al. | 19/157 |

FOREIGN PATENT DOCUMENTS

| | | |
|---|---|---|
| 4108362 A1 | 10/1991 | (DE) . |
| 4035439 A1 | 5/1992 | (DE) . |
| 4215158 A1 | 11/1992 | (DE) . |

OTHER PUBLICATIONS

European Search Report With Translation.

* cited by examiner

*Primary Examiner*—John J. Calvert
*Assistant Examiner*—Gary L. Welch
(74) *Attorney, Agent, or Firm*—Dority & Manning

(57) ABSTRACT

The instant invention relates to a process and to a device for automatic introduction of a fiber sliver into a textile machine equipped with a feed mechanism. The end of the fiber sliver is brought into a defined receiving position in which it is introduced into the feed mechanism. A predetermined length of the end of the fiber sliver is seized. The sliver is then shortened to a second predetermined length and is then introduced into the feed mechanism.

5 Claims, 3 Drawing Sheets

PROCESS AND DEVICE FOR THE AUTOMATIC INTRODUCTION OF A FIBER SLIVER

This application is a divisional application of application Ser. No. 08/164,389, filed on Dec. 9, 1993, now U.S. Pat. No. 5,996,182.

BACKGROUND OF THE INVENTION

The present invention relates to a process and to a device for the automatic introduction of a fiber sliver into a textile machine equipped with a feed mechanism. The fiber sliver is brought with its end into a defined receiving position in which it is introduced into the feed mechanism.

DE 40 35 439 A1 discloses a method by which a fiber sliver end hanging out of a can is taken up by a relative movement between fiber sliver and sliver feeder and is then prepared for introduction into a spinning machine. To prepare this fiber sliver, it is proposed that a piece of the grasped fiber sliver end be torn off, causing a thinning out and tapering of the fiber sliver end.

In this known embodiment, it is a disadvantage that the fiber sliver end which was torn off must be scrapped. This causes a loss in raw material and the problem of collecting and removing scrap which is produced in large quantities in the course of the operation of the device. Another disadvantage of this known embodiment is the fact that the fiber sliver end to be grasped by the feed mechanism becomes so thin because of the thinning-out and tapering of the fiber sliver end before its introduction into the feed mechanism that the desired result is not achieved with some materials.

OBJECTS AND SUMMARY OF THE INVENTION

It is therefore a principal object of the instant invention to create a process and a device for the automatic introduction of a fiber sliver that can be used reliably with all materials and results practically in no material loss. Additional objects and advantages of the invention will be set forth in, or obvious from, the following description, or may be learned by practice of the invention.

The objects are attained by a process in which a predetermined length of the end of the fiber sliver is grasped, is shortened to a second predetermined length, and is then introduced into the feed mechanism. In this process it is advantageous that fiber slivers of very different lengths can be presented to the grasping device by grasping a first predetermined length of a fiber sliver. Thanks to the great allowable tolerance in fiber sliver presentation, the first predetermined length, which is relatively great by comparison with the second predetermined length is securely grasped. The greater the first predetermined length, the greater the tolerances which can be allowed in fiber sliver presentation.

For further processing, in particular for the introduction of the fiber sliver into the feed mechanism, it is advantageous if the fiber sliver length is as short as possible. This makes it possible to obtain more precise introduction movements when the fiber sliver is slack. Due to the fact that the first grasped length is known, simple automatic process, such as by means of time control or distance control components, can be used to shorten the fiber sliver to the second predetermined length.

According to the invention, the fiber sliver end is grasped by a first grasping device and is then transferred to a second grasping device. The first predetermined length of the fiber sliver end is set in the first grasping device, and the fiber sliver is shortened to the second length in the second grasping device.

The fiber sliver is advantageously grasped by the first grasping device at the can in which the fiber sliver is presented to the textile machine. The second grasping device conveys the fiber sliver into proximity of the feed mechanism of the textile machine and assists in the subsequent introduction.

The first predetermined length is advantageously obtained by means of a suction pipe. The suction pipe seizes a fiber sliver end hanging over the rim of the can and sucks it in. If long cans are used, where the fiber sliver end hangs over the narrow side of the long can, it suffices to convey the suction pipe along this narrow side. If the suction pipe grasps the fiber sliver at a point where the length to the end of the fiber sliver is shorter than the length of the suction of the suction pipe, the fiber sliver end is sucked into the suction pipe and is pulled straight. The suction pipe is advantageously delimited at a point in such manner that the fiber sliver can be sucked in only as far as that point. Additionally, missing fiber sliver is pulled from the can so that the suction pipe is completely filled with fiber sliver up to the limit point. If the fiber sliver end hanging from the can is longer than the suction point from the point at which it is seized to its end, a loop forms in the suction pipe. The loop is disappears again after transfer to the second grasping device.

The fiber sliver, of which a predetermined length is now present, is conveyed by this first grasping device to a second grasping device. The second grasping device is advantageously designed so that it grasps the fiber sliver on the one hand, and is able to change the length of the fiber sliver on the other hand. When the fiber sliver has been shortened, the second grasping device conveys the fiber sliver to a loop catcher of the feed mechanism. If the fiber sliver is sucked in by the loop catcher on the one hand and is conveyed by the second grasping device through the loop catcher on the other hand while the fiber sliver is again extended in the second grasping device, easy and secure introduction of the fiber sliver is ensured.

If the fiber sliver is brought to a point after passing through the loop catcher or before introduction into the feed mechanism, this introduction into the feed mechanism is facilitated. Fibers in the fiber sliver would then not stick out and would not cause problems with the introduction.

The fiber sliver is advantageously introduced into the feed mechanism by a conveyor. If the feed mechanism is opened before the introduction of the end of the fiber sliver and is closed again when the end of the fiber sliver is present between the feed rollers, the introduction process is facilitated.

The fiber sliver is advantageously assisted by the conveyor, as well as by the second grasping device which guides the fiber sliver as it is introduced into the feed mechanism.

The device according to the invention is designed so that the end of the fiber sliver can be received by a first grasping device at a first predetermined length and can be shortened to a second predetermined length by means of a second grasping device. The two grasping devices make it possible to receive first a fiber sliver to which great tolerances apply and to shorten this fiber sliver subsequently to a length that is suitable for introduction of the fiber sliver into the feed mechanism.

It is especially advantageous for the first grasping device to be a suction pipe. To limit the length of the aspired fiber sliver, a sieve is advantageously provided. The aspired fiber sliver is thus aspired as far as the sieve, plugs up the sieve and thus terminates the suction process. The fiber sliver is then present in a defined length which corresponds to the length of the suction pipe.

To avoid that fibers of the fiber sliver hook into the sieve, the sieve is given a relatively great length. This length makes it impossible for the fibers to form hooks behind the sieve on the one hand, and from remaining in the fiber sliver on the other hand. Thus, as the fiber sliver is removed, such fibers do not hook into the sieve and thus do not plug up the sieve in course of its utilization.

The first grasping device is advantageously brought in such manner to a can containing the fiber sliver that it reaches the area in which an end segment of the fiber sliver is located. If the can is a so-called long can it suffices if the grasping device searches a narrow side of the can for the presence of a fiber sliver if the fiber sliver has been deposited on this narrow side. With round cans it may be necessary for the grasping device to search for and to take up the fiber sliver on the circumference of the round can. It is also possible for the fiber sliver end to be held in a clamp provided on the can, from which the first grasping device can take up the fiber sliver. In this case, it is important for the first grasping device to find contact with the fiber sliver to be able to take it up and to bring it to the predetermined length.

The first grasping device advantageously transfers the fiber sliver to the second grasping device. It is important here for the length of the fiber sliver taken up by the first grasping device to be maintained in a defined manner so that the length may be shortened also in a defined manner in the second grasping device.

According to the invention, the second grasping device is a roller clamp. During transfer, the rollers are open and clamp the fiber sliver by changing the radial distance between rollers and fiber sliver. Due to the fact that at least one roller can be driven actively, the length of the fiber sliver can be reduced. One roller can advantageously be driven actively in both directions, so that the fiber sliver length can first be reduced and can again be extended as the fiber sliver is then introduced into the feed mechanism. To achieve additional reliability in obtaining a defined length of the fiber sliver in the second grasping device, a sensor which detects the end of the fiber sliver is provided at the second grasping device.

According to the invention, the second grasping device conveys the fiber sliver into range of a loop catcher at the feed mechanism. When a suction pipe is presented to the loop catcher, the fiber sliver can be conveyed pneumatically through the loop catcher on the one hand, and can be conveyed mechanically by the roller clamp on the other hand.

The introduction of the fiber sliver into the feed mechanism is especially facilitated if the feed mechanism can be open during the introduction of the fiber sliver. This causes the distance between the rollers of the feed mechanism to be increased so that the fiber sliver can be introduced between the rollers of the feed mechanism.

The introduction of the fiber sliver into the feed mechanism is effected advantageously by means of a conveyor. This conveyor is advantageously a driven conveyor belt which presses the fiber sliver against the introduction funnel of the feed mechanism and introduces the fiber sliver into the feed mechanism as the conveyor belt is being driven.

The device according to the invention can be installed on a service unit used to service the textile machine, the so-called automatic travelling carriage, as well as on a can conveying vehicle which supplies one or several textile machines with cans.

The invention is described in greater detail through the figures, which constitute a part of this description.

DETAILED DESCRIPTION OF THE PREFERRED EMBODIMENTS

Figure 1:
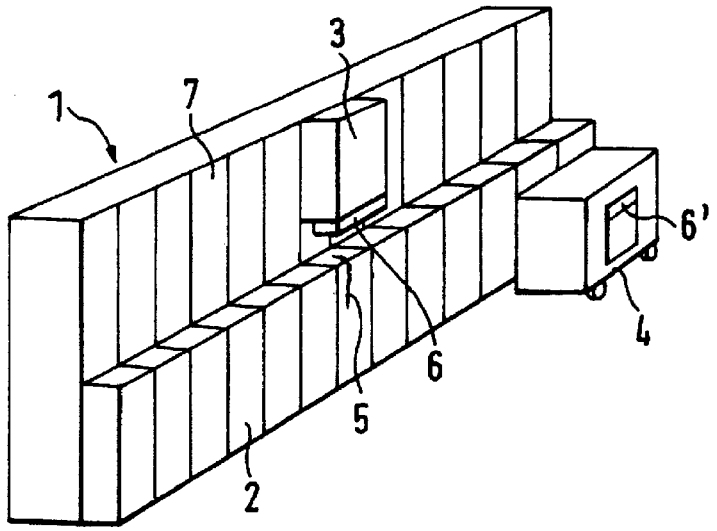
FIG. 1 shows a textile machine with a service unit and a can conveying vehicle.

Reference will now be made in detail to the presently preferred embodiments of the invention, one or more examples of which are illustrated in the drawings. Each example is provided by way of explanation of the invention and not as a limitation of the invention. The numbering of components is consistent throughout the description, with the same components having the same number in each of the drawings.

FIG. 1 shows a textile machine with a service unit and a can conveying vehicle. The textile machine in this embodiment is an open-end rotor spinning machine with a plurality of spinning stations 7 installed next to each other. Each spinning station is assigned a can 2 in which the fiber sliver 5 is presented to the spinning station. The device 6, 6' according to the invention may be installed either on a service unit 3 or on a can conveying vehicle 4. The can conveying vehicle 4 delivers the full cans 2 to the textile machine 1 and removes the empty cans 2 from the textile machine 1. After replacing an empty can 2 with a full one, the can conveying vehicle 4 equipped with the device 6' according to the invention is able to convey the fiber sliver end 5 hanging out of the can 2 to a feed mechanism at the appertaining spinning station.

The device according to the invention can also be installed on a service unit 3. The service unit 3 is normally assigned to one single textile machine. The service unit 3 travels past the existing spinning stations of the textile machine 1 and carries out various tasks such as cleaning the spinning station, yarn piecing and also sliver introduction in the application according to the invention. It is also possible to use the service unit exclusively for sliver introduction with the utilization of the device 6 according to the invention. The device 6', 6 according to the invention can furthermore be used with other textile machines which are not shown here, where fiber slivers must be supplied to the textile machine automatically for further processing. The service unit 3 is advantageously equipped with sensors 51 which detect in the direction of travel of the service unit 3 whether a fiber sliver 5 must be replaced and which stop at the appropriate spinning station in order to replace the fiber sliver 5.

Figure 2:
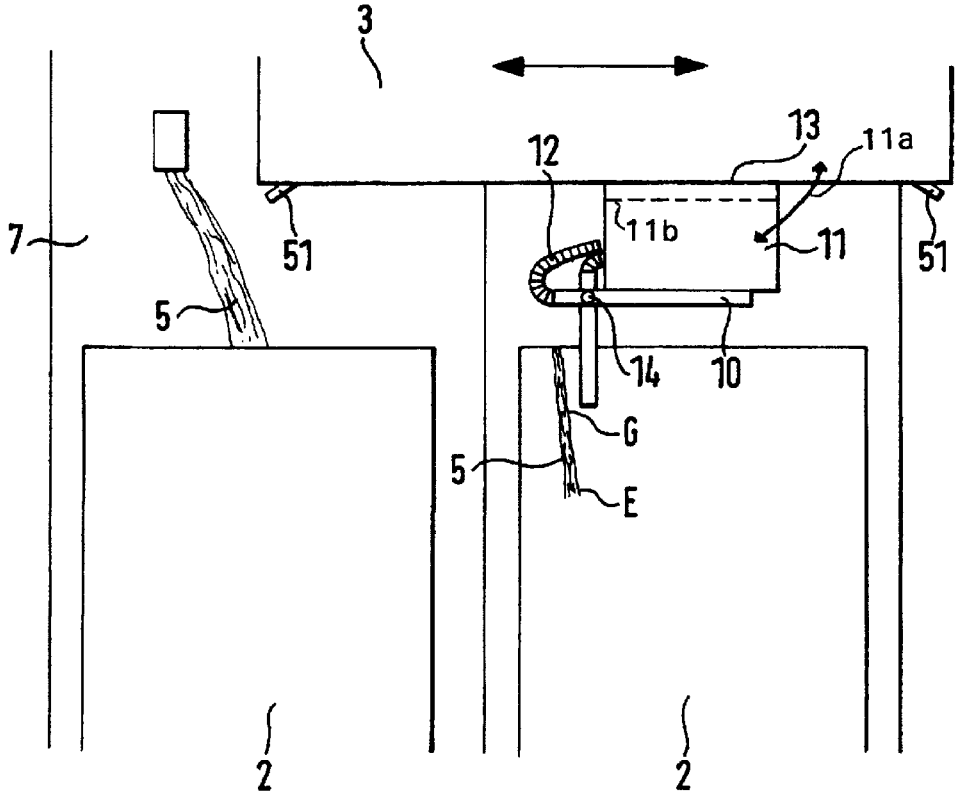
FIG. 2 shows a first grasping device.
Figure 4:
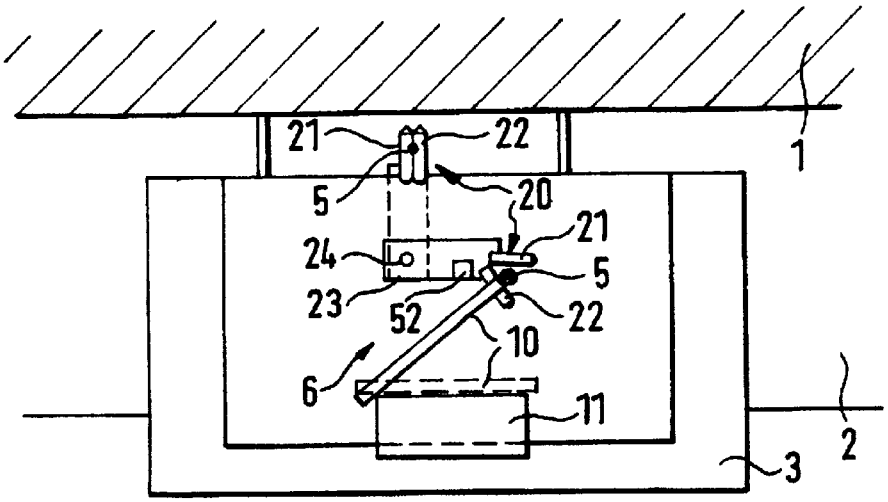
FIG. 4 shows the transfer of the fiber sliver from the first grasping device to the second grasping device.

FIG. 2 shows the first grasping device according to the invention in further detail. FIGS. 2 and 4 illustrate the embodiment of the service unit 3. They are however also applicable to installation on a can conveying vehicle 4.

The service unit 3, which travels back and forth alongside the textile machine 1 (as shown by the double arrow) until servicing becomes necessary at a spinning station, is stationed at a spinning station in this example of an embodiment according to the invention. A suction pipe 10 and extension 11 are located under the service unit 3. The extension 11 is swivelled line 6, delete "over an extension 11" and substitute therefor downward from dashed-lined position 11*b* to the position shown, as shown by arrow 11*a*, to within range of can 2. The suction pipe 10 can be swivelled alongside can 2 via joint. The suction pipe 10 is connected via a nose 12 to a negative pressure source. By swivelling the suction pipe 10 and the extension 11, it is advantageously possible to transfer the received fiber sliver 5 to a second grasping device.

The suction pipe 10 glides over a forward area of can 2 as it swivels around joint 14. If the fiber sliver 5 is present in this area of which the suction pipe 10 glides it is sucked into the suction pipe 10 in which negative pressure prevails. In addition to the simple embodiment shown in which the suction pipe 10 is swivelled around the joint 14, it is also possible according to the invention for the suction pipe 10 to be moved alongside a longitudinal guide on the can 2.

During aspiration, the fiber sliver 5 straightens itself out in the suction pipe 10. For this, it is necessary that the length of the fiber sliver 5 be shorter between point G, where the fiber sliver 5 is seized by the suction pipe 10, and the end point E of the fiber sliver 5 than the free length F (FIG. 3*a*) of the suction pipe 10 into which the fiber sliver 5 is sucked. If this condition is met, the fiber sliver is sucked in a straight position into the suction pipe 10. The missing length of the fiber sliver 5 is pulled out of can 2. The longer the suction pipe 10, the greater the tolerance allowable with which the fiber sliver 5 may hang over the can 2.

As soon as the suction pipe 10 has aspired the fiber sliver 5, it is swivelled around the joint 14 and extension 11 is swivelled around 13 in the direction of the arrow, so that it is brought together with the fiber sliver into a position in which the aspired fiber sliver with the first predetermined length can be transferred to another grasping device.

Figure 3A:
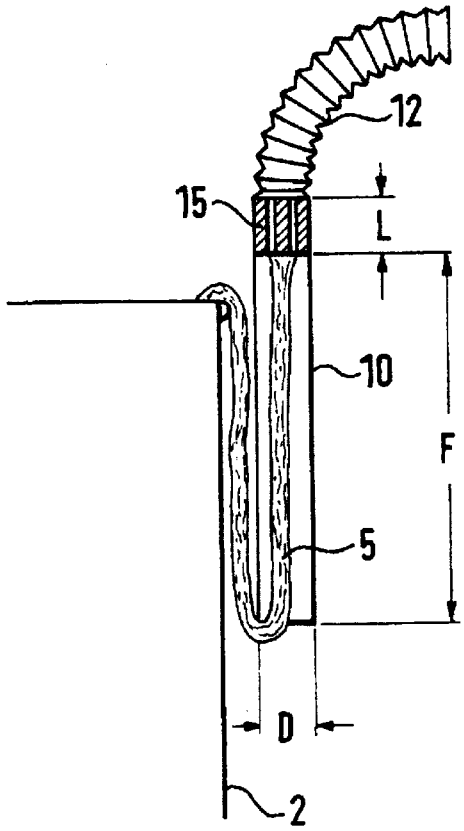
FIG. 3 shows a suction pipe with a grasped fiber sliver.
FIG. 3*b* shows a sieve.

FIG. 3*a* shows the suction pipe 10 having length F and diameter. Suction pipe 10 is located in the area immediately in front of the can 2 from which the fiber sliver 5 hangs out. The fiber sliver 5 reaches the suction range of suction pipe lo and is sucked into the suction pipe 10. As soon as the fiber sliver meets a sieve 15, the sieve 15 is plugged up and the aspiration of the fiber sliver 5 is terminated. The sieve 15 has a length L. The length L is greater than the staple length of the fiber material to be processed. Thanks to this length L, a clogging of the sieve after withdrawal of the fiber sliver 5 from the suction pipe 10 is effectively prevented. The fibers of the fiber sliver 5 are not able to catch in the suction holes of the sieve 15 and thus clog it thanks to the relatively great length L of the sieve 15.

In an advantageous embodiment, the sieve 15 can be taken out of the suction pipe 10 for cleaning. Cleaning may become necessary if solid particles sucked in together with the fiber sliver 5 clog the holes of the sieve 15. An additional cleaning possibility exists if the sieve 15 is mounted rotatably in the suction pipe 10. If the sieve is rotated at time intervals it is subjected to suction on both sides. This also cause dirt to be removed from the sieve.

Figure 3B:
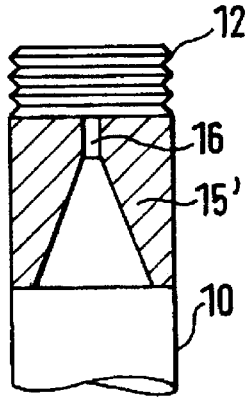

In the embodiment of FIG. 3*b* the sieve 15' is provided with only one opening. The suction opening however tapers conically from the suction pipe 10 to the opening 16. The opening 16 is cylindrical. Catching of the fibers and thereby clogging of the sieve 15' is thus effectively prevented.

The device 6 according to the invention is shown in a top view in FIG. 4. It is installed on the service unit 3. Upon reception of the fiber sliver 5, the suction pipe 10 is swivelled around joint 14. The extension 11 then swivels into a position in which the fiber sliver 5 is conveyed to a roller clamp 20 by renewed swivelling of the suction pipe 10. When the suction pipe 10 has conveyed the fiber sliver 5 between the open rollers 21 and 22 of the roller clamp 20, the rollers 21 and 22 are brought radially closer together so that the fiber sliver 5 is clamped.

Following this transfer of the fiber sliver 5 from the first grasping device to the second grasping device which is made in the form of a grasping and conveying device, at least one of the rollers 21 and 22 is driven. Due to the fact that the fiber sliver 5 transferred by the suction pipe 10 has a defined length, the fiber sliver 5 can be shortened to a defined second length by controls which drive the driven roller 21 or 22, e.g. at a defined time. An additional assurance that a defined second length of the fiber sliver 5 will be attained is provided by a sensor 52 which detects the end of the fiber sliver 5 directly in front of the rollers 21 and 22 and gives the signal to stop the rotational movement of said rollers 21 and 22. Sensor 52 also detects whether a sliver has been aspired by suction pipe 10. When the fiber sliver end which extends beyond the roller clamp 20 has been shortened to the desired length, the suction pipe 10 swivels back to the extension 11. The roller clamp 20 which is mounted on a swivel arm 23 swivels via joint 24 in the direction of the textile machine 1. This swivelling motion causes the fiber sliver 5 to be positioned directly in front of the feed mechanism.

Depending on the geometry, it may be necessary for the shown joints 13, 14 and 24 to execute not exclusively rotational movements but, in addition, longitudinal movements in order to take up the fiber sliver 5 from the spinning can 2, to transfer it to the roller clamp 20 and to convey it to the feed mechanism.

Figure 5:
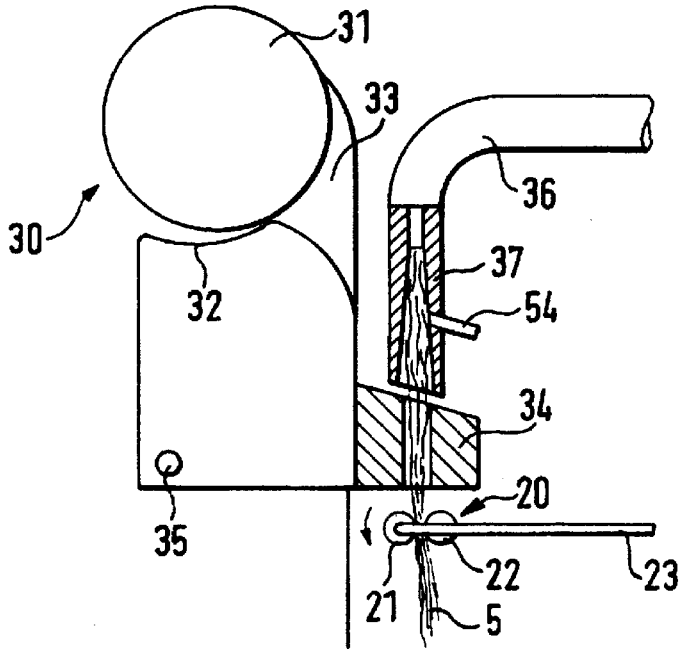
FIG. 5 shows the passage of the fiber sliver through the loop catcher.
Figure 6:
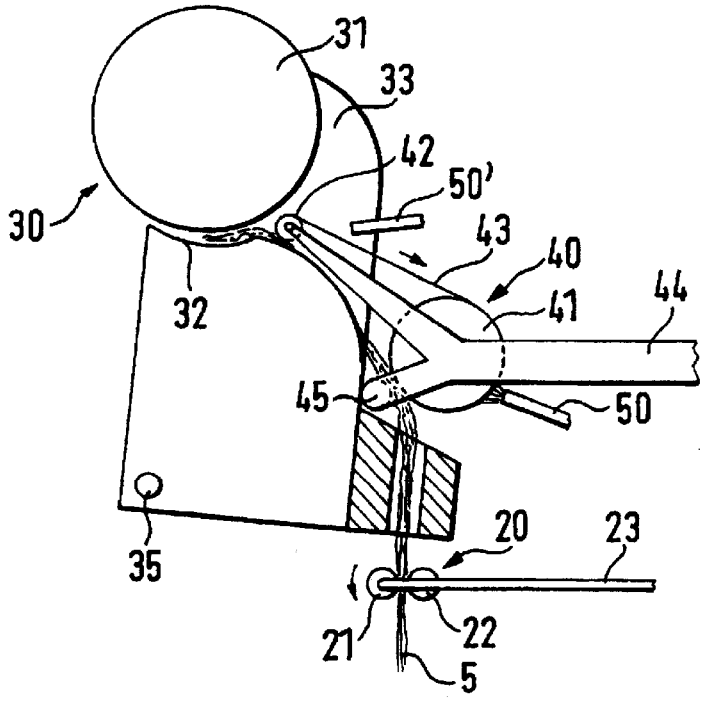
FIG. 6 shows the introduction of the fiber sliver into the feed mechanism.

FIGS. 5 and 6 show a detail of a feed mechanism 30 with a loop catcher 34. During normal spinning operation the fiber sliver 5 is conveyed by the loop catcher and through insertion funnel 33 between feed roller 31 and feed tray 32 to the spinning station. The loop catcher 34 is not used in some embodiments. The embodiment described below in connection with FIG. 5 is not to be used in that case.

In the embodiment of FIG. 5 the swivel arm 23 with the rollers 21 and 22 of the roller clamp 20 holding the fiber sliver 5 is positioned under the loop catcher 34. A suction pipe 36 is positioned above the loop catcher 34. The suction pipe 36 is connected to a source of negative pressure. The suction force produced by the suction pipe 36 takes effect upon the fiber sliver 5 through the opening of the loop catcher 34. As soon as the fiber sliver 5 has been sucked through the opening of the loop catcher 34, the fiber sliver 5 is guided into an insert 37 of the suction pipe 36 by a rotating motion of the rollers 21 and 22. The end of the fiber sliver 5 is made into a point as a function of the configuration of insert 37. The pointing or concentration of the fibers of the fiber sliver end facilitates the subsequent processes for the introduction of the fiber sliver 5 into the feed mechanism 30. The fiber sliver can also be achieved also by appropriate air flow in the suction pipe 36, aside from the formed insert 37.

When the fiber sliver 5 has been conveyed through the loop catcher 34 and the point of the fiber sliver 5 has been formed, the suction pipe 36 swivels again away from the loop catcher 34. To remove loose fibers in the fiber sliver point it may be advantageous to provide a blow nozzle 54. Loose fibers are thus blown out of the fiber sliver point. This ensures secure introduction of the fiber sliver into the feed mechanism.

FIG. 6 shows how the fiber sliver 5 is introduced by means of a mechanical conveyor between the feed roller 31 and the feed tray 32. The conveyor 40 consists of a holding support 44 on which deflection pulleys 41 and 42 are installed. A belt 43 serving as a conveyor belt is laid over the deflection pulleys 41 and 42. When the deflection roller 41 and 42 is driven the belt 43 is moved in such manner that it conveys the fiber sliver 5 held between belt 43 and insertion funnel 33 to the top of the insertion funnel 33 until it is between the open feed roller 31 and the feed tray 32. This conveying movement is assisted by the driven roller 21 and/or 22 which convey the fiber sliver 5 on.

The feed mechanism 30 is opened by changing the distance between the feed roller 31 and the feed tray 32 so that the fiber sliver 5 can be introduced between the feed roller 31 and the feed tray 32. The feed mechanism 30 is opened by means of a depressor 45 which is located on the holding support 44. By presenting the conveyor 40, the depressor 45 is simultaneously applied to a notch between loop catcher 34 and insertion funnel 33, or in a tray on the insertion funnel 33 which is specially provided for this. The insertion funnel 33 is thereby pivoted together with the loop catcher 34 around a pivot joint 35. The feed tray 32 is attached at the insertion funnel 33 so that a rotation around the pivot joint 35 causes this feed tray 32 to be moved away radially from the feed roller 31.

In an advantageous embodiment of the invention a device 50, 50' is brought to the belt 43 to clean it. This device 50, 50' may be a suction or blow nozzle, or a mechanical stripping device. To avoid disturbances in the transfer of the fiber sliver to the feed mechanism, it is advantageous to use antistatic belts 43. If the device 50' is a blow nozzle the fiber sliver 5 is blown off belt 43 and rolling up of the belt 43 is prevented.

When the holding support 44 with the conveyor 40 and the depressor 45 is moved away from the feed mechanism following successful insertion of the fiber sliver 5, an elastic force again presses the feed tray 32 against the feed roller 31 and the fiber sliver 5 is clamped between the feed roller 31 and the feed tray 32. After the insertion of the fiber sliver, a signal which starts the rotation of the feed roller 31 is advantageously produced. Only then is the feed mechanism closed and the fiber sliver is pulled into the feed mechanism. This ensures that the fiber sliver does not fall out of the feed mechanism before the clamping action of the feed mechanism takes effect. By driving the feed roller 31 and the feed tray 32, the fiber sliver 5 is pulled in to the textile machine 1.

Upon successful insertion of the fiber sliver 5 into the feed mechanism 30, the rollers 21 and 22 of the roller clamp 20 are opened by increasing the radial distance between them. The swivel arm 23 is swivelled back into its starting position. The service unit 3 or the can conveying vehicle 4 can now leave the feed mechanism to which it has automatically applied the fiber sliver 5.

This description is not limited to the embodiment shown as an example. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come with the scope of the appended claims and their equivalents.

What is claimed is:

1. A process for the automatic introduction of a fiber sliver into a textile machine having a feed mechanism, said process comprising initially grasping the leading end of a length of fiber sliver hanging over a rim of a sliver storage can with a suction device; and delivering the leading end of the fiber sliver to the feed mechanism in such a manner that substantially only the leading end of the fiber sliver is delivered directly to the feed mechanism without releasing the leading end of the fiber sliver after said initial grasping until after the leading end has been precisely introduced into the feed mechanism which subsequently draws the fiber sliver from the storage can.

2. The process as in claim 1, comprising moving the suction device along a side of the sliver storage can having the length of fiber sliver hanging over the rim thereof and sucking the leading end and at least a portion of the length of fiber sliver into the suction device.

3. The process as in claim 1, comprising mechanically delivering the leading end of the fiber sliver to the feed mechanism.

4. A process for the automatic introduction of a fiber sliver into a textile machine having a feed mechanism, said process comprising initially grasping the leading end of a length of fiber sliver hanging over a rim of a sliver storage can with a suction device; and delivering the leading end of the fiber sliver to the feed mechanism in such a manner that substantially only the leading end of the fiber sliver is delivered directly to the feed mechanism; and further comprising transferring the leading end of the fiber sliver from the suction device to a grasping device and delivering the leading end of the fiber sliver to the feed mechanism with the grasping device.

5. The process as in claim 4, further comprising suctioning a predetermined length of the fiber sliver with the suction device and shortening the predetermined length of fiber sliver with the grasping device prior to delivery to the feed mechanism.

* * * * *